United States Patent [19]

Specht

[11] 4,078,987

[45] Mar. 14, 1978

[54] VACUUM ASSISTED ASSEMBLY METHOD FOR ELECTROLYTIC CELLS AND APPARATUS FOR UTILIZING SAME

[75] Inventor: Steven J. Specht, Cleveland, Tenn.

[73] Assignee: Olin Corporation, New Haven, Conn.

[21] Appl. No.: 782,643

[22] Filed: Mar. 30, 1977

[51] Int. Cl.[2] ..... C25B 15/00; C25B 9/00

[52] U.S. Cl. ..... 204/266; 204/252; 204/263

[58] Field of Search ..... 204/295, 252, 266, 263

[56] References Cited

U.S. PATENT DOCUMENTS

| | | | |
|---|---|---|---|
| 1,865,152 | 6/1932 | Stuart | 204/295 |
| 2,326,101 | 8/1943 | Nichols | 204/295 |
| 3,022,244 | 2/1962 | Le Blanc et al. | 204/295 |

*Primary Examiner*—R. L. Andrews

*Attorney, Agent, or Firm*—Bruce E. Burdick; Donald F. Clements; Thomas P. O'Day

[57] ABSTRACT

Apparatus and method are disclosed for facilitating electrode installation in diaphragm type electrolytic cells. The apparatus includes a vacuum generator for pulling the diaphragm against a first electrode during insertion between two other spaced electrodes. The method relates to the use of a pressure differential to pull the diaphragm against the electrode during assembly of the cell.

38 Claims, 9 Drawing Figures

VACUUM ASSISTED ASSEMBLY METHOD FOR ELECTROLYTIC CELLS AND APPARATUS FOR UTILIZING SAME

There are two primary methods used for commercial production of chlorine gas and caustic. One of these is the mercury electrolytic cell, first developed commercially around 1895 and still the subject of many improvements. The other, and the one with which this application is concerned is the diaphragm electrolytic cell, which was commercially developed beginning about 1890.

In a typical diaphragm cell sodium or potassium chloride brine, nearly saturated and at about 60° to 70° C is fed into the anolyte, where chlorine gas is formed and the sodium or potassium ionized flows through the diaphragm into the catholyte where alkali is formed. Flow is continuous with a differential head maintaining flow through the diaphragm from anolyte to catholyte.

One typical construction of a diaphragm type cell is a canlike structure having interleaved sheet-like electrodes, one of which carries or supports the diaphragm. Conventionally, the diaphragm has been made of asbestos fibers. A problem arises due to the necessity of having relatively close fitting anodes and cathodes in order to reduce the amount of energy lost in the production of heat. These close tolerances can result in the diaphragm being damaged during assembly of the cell when the anodes are inserted between the cathodes or vice versa.

One means for solving this problem was developed and involved the use of a contractible electrode biased outwardly by springs. A retainer is provided to hold the springs in retracted position until inserted between the opposite electrodes of the cell. The springs are released by removing the retainers after the electrodes are inserted and the springs then expansively bias the electrode to maintain a suitable anode-cathode gap. However, there is a problem as to how exactly the retainers are to be removed without loss or damage to the cell components, especially if the electrode is enclosed by a diaphragm.

The present invention solves these and other problems by providing a method of assembling a diaphragm electrolytic cell having a foraminous electrode, which comprises the steps of:

a. surrounding said first foraminous electrode with a diaphragm;
b. creating a pressure differential across said diaphragm so as to force said diaphragm against said first electrode;
c. maintaining said pressure differential across said diaphragm while inserting said first electrode between two spaced electrodes; and
d. thereafter eliminating said created pressure differential.

The present invention also solves these problems and others by providing an apparatus comprising:

a. an electrolytic cell assembly including:
   i. a first foraminous electrode;
   ii. support means, attached to said electrode, for supporting said electrode; and
   iii. diaphragm means, attached to one of said electrode and said support means, for surrounding said electrode and restricting gas movement across said diaphragm;
   iv. a second and third electrode spaced so as to receive said first electrode therebetween;

b. vacuum generator means, operably attached to one of said first electrode, said support means and said diaphragm means, for creating a pressure differential across said diaphragm so as to force said diaphragm against said first electrode; and
c. installer means, operably attached to said electrolytic cell assembly, for moving said first electrode between said second and third spaced electrodes while allowing said vacuum generator means to maintain said differential pressure across said diaphragm during such movement.

The objects and advantages of the present invention are best understood by reference to the following drawing in which.

Figure 2:
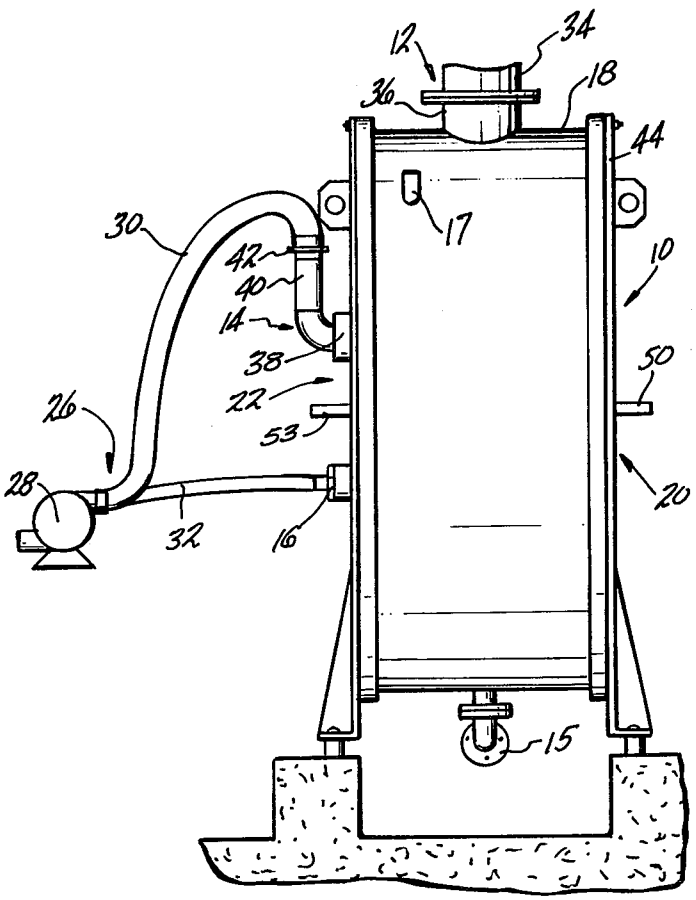
FIG. 2 is a right side elevational view of the cell assembly of FIG. 1 with a vacuum generator means attached thereto.
Figure 1:
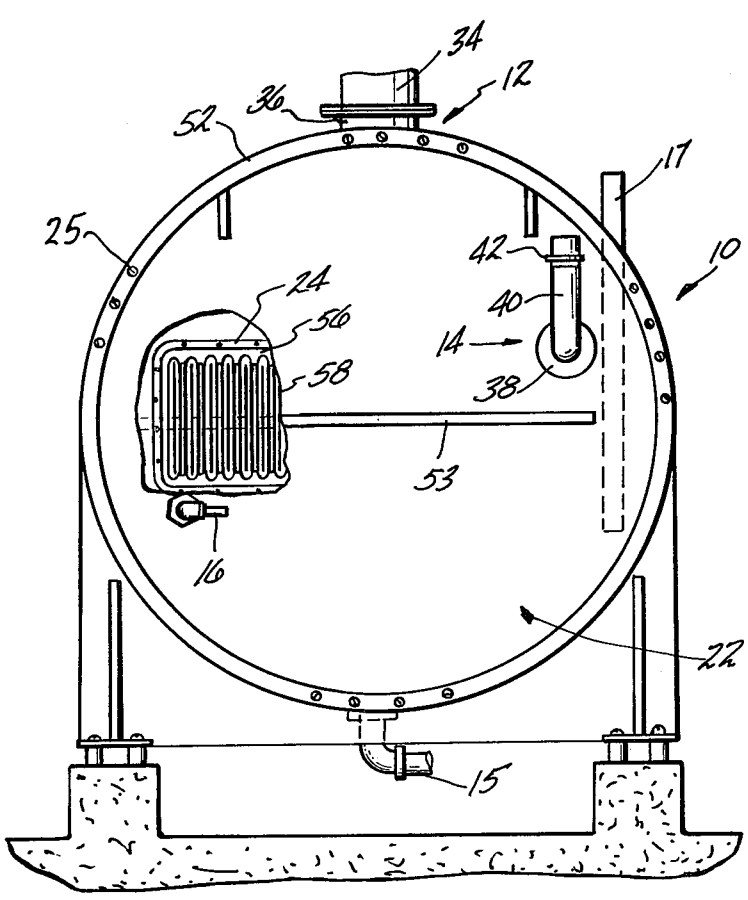
FIG. 1 is a front view of a preferred diaphragm electrolytic cell assembly.
Figure 3:
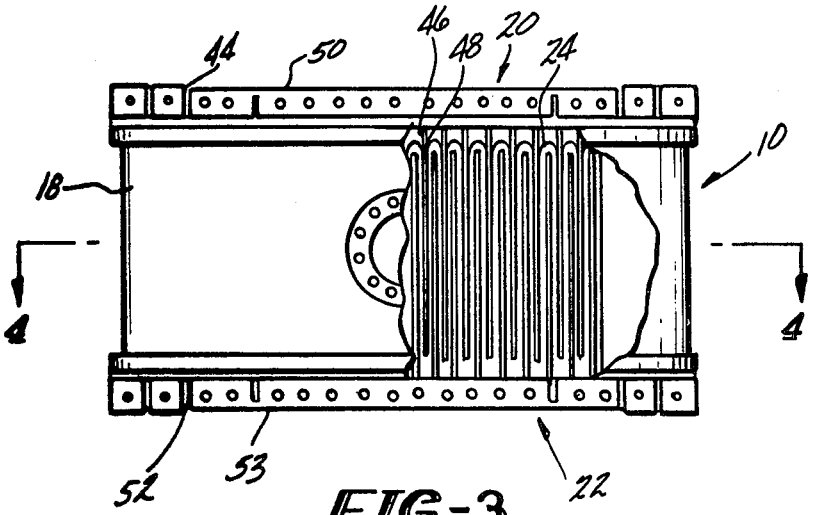
FIG. 3 is a top plan view of the cell assembly of FIGS. 1 and 2.
Figure 4:
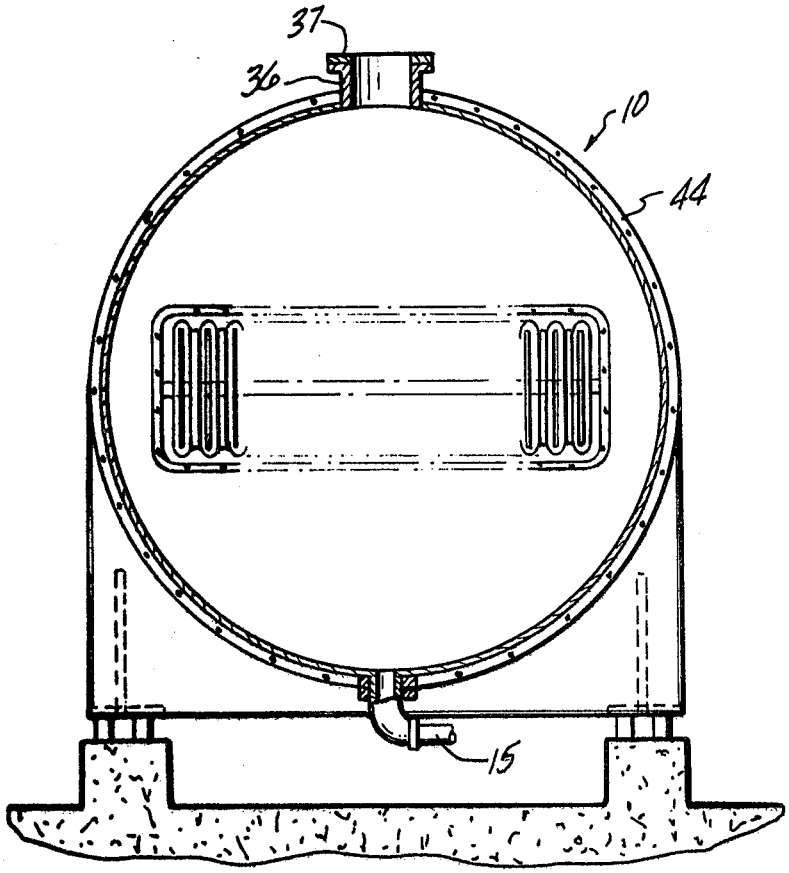
FIG. 4 is a vertical sectional view along lines 4—4 of FIG. 2 showing the electrode location within the cell assembly of FIGS. 1, 2 and 3.
Figure 8:
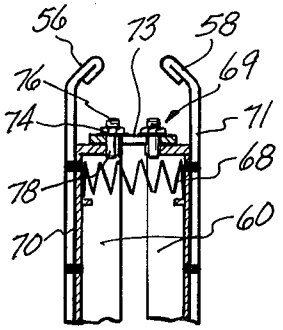
Figure 7:
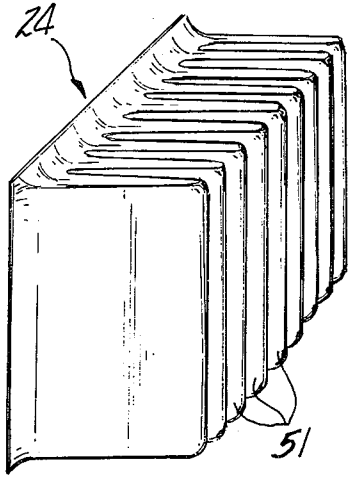
Figure 6A:
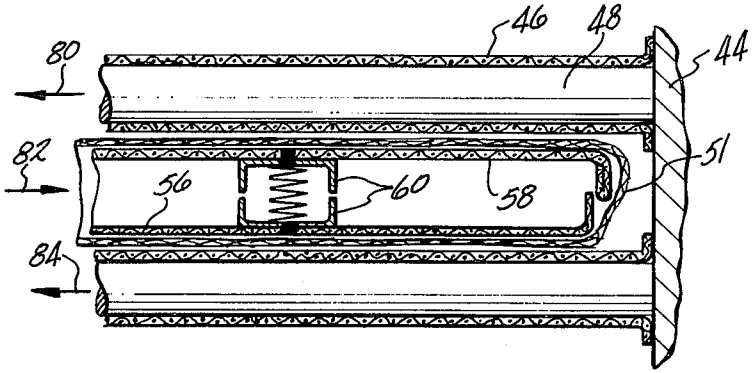
Figure 5:
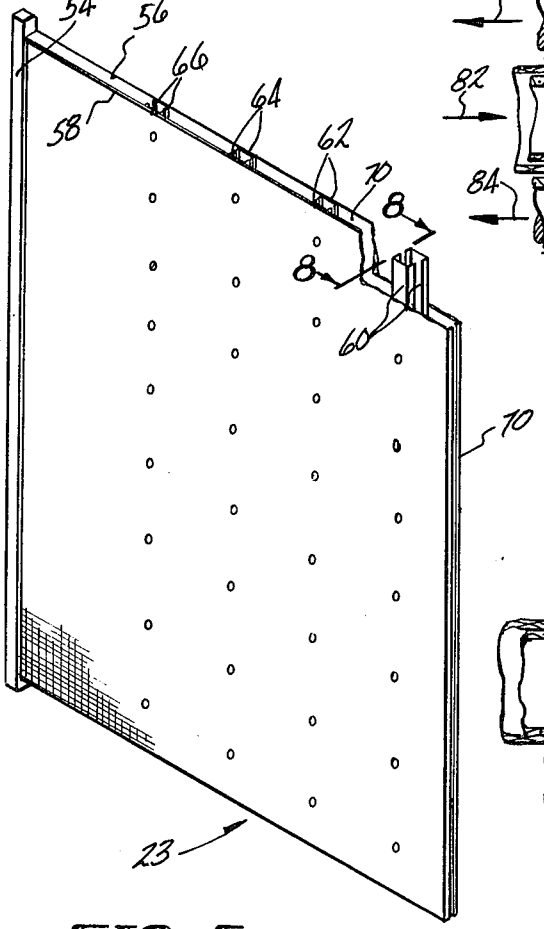
FIG. 5 is an isometric view of the preferred expandable cathode of the cell assembly of FIGS. 1-4.

FIG. 6*a* is a top partial sectional view along lines 6—6 of FIG. 2, showing the cathode of FIG. 5 in contracted installed position;

FIG. 6*b* is a top partial sectional view along lines 6—6 of FIG. 2, showing the cathode of FIG. 5 in expanded installed position;

FIG. 7 is an isometric view of a preferred diaphragm assembly adapted for the cell assembly of FIGS. 1-5;

FIG. 8 is a side sectional view of a keeper assembly of the cathode assembly taken along line 8—8 of FIG. 5.

FIGS. 1-6 show a preferred embodiment of the invention and are not intended as the only embodiment, but rather as an example. The particular embodiment shown is that of U.S. Pat. No. 3,898,149 the entire disclosure of which is hereby incorporated by reference as if set forth at length.

FIGS. 1, 2, 3 and 4 give an overall view of a chloralkali electrolytic diaphragm cell 10 comprising an anolyte outlet section 12, a catholyte outlet section 14, a drain 15, a caustic outlet 16, a brine inlet 17, a cell body 18, an anode assembly 20, a cathode assembly 22 and a diaphragm assembly 24. Also shown is a vacuum generator assembly 26 comprising a pump 28 and one or more hoses 30 and 32. The anolyte section comprises a chlorine transfer pipe 34, a chlorine vent 36, and a seal 37. Chlorine gas produced in the anodic portion of the cell 10 passes upwardly through cell body 18 and into anolyte outlet section 12 where it is received by chlorine vent pipe 36 and passes upwardly and outwardly through chlorine transfer pipe 34. The chlorine pipes 34 and 36 can be lined with a wet chlorine-resistant material to lessen corrosion. The catholyte outlet section 14 comprises a hydrogen vent 38 and hydrogen outlet pipe 40. Outlet pipe 40 has some connector means 42 for securing hose 32 thereto to allow pump 28 to withdraw fluid from pipe 40 for reasons below described and hose 30 has a conforming connector to allow such connection. Similarly, hose 32 and caustic outlet 16 have conforming connectors to allow connection therebetween for reasons below described. It will be appreciated that chlorine vent 36 could also have a connector means for connection of hose 30 or 32 thereto in the event fluid withdrawal therefrom by pump 28 is desired for reasons explained below. Caustic outlet 16 can be a flanged pipe welded to a portion of cell body 18 to allow the caustic product to exit the cell. The brine inlet 17 of the cell, together with the electrical input from the cathode-anode current flow provide the raw materials going into the system.

The invention can also be similarly utilized on other types of electrolytic cells making other products from other raw materials. Cell body 18 can be a cylindrical tubular member of greater diameter than depth, although the dimension and shape of cell body 18 could be varied depending on amount of space available, amount of product per cell desired, number of electrodes desired per cell and many other conventional considerations.

Anode assembly 20 includes a disc-shaped anode back plate 44, a plurality of wire mesh anode screens 46, a plurality of distributor rods 48 and one or more suitable bus bars 50. The backplate can have a lining (not shown) to increase chlorine resistance. Current is fed through bus bars 50 and rods 48 to screen 46 which is in contact with an anolyte solution. Current then passes through the anolyte solution to produce chlorine in conventional manner, through diaphragm assembly 24 to the catholyte solution and therethrough to the cathode assembly.

FIG. 7 is an isometric view of a preferred diaphragm assembly 24 comprising a plurality of bag-like planar finger panels 51 interconnected to form a continuous diaphragm adapted to fit more or less snugly over a plurality of planar electrodes, and is sealingly clamped to backplate 52 to create a catholyte chamber therewithin. An example of such an assembly is the diaphragm assembly shown and described in my copending U.S. patent application Ser. No. 772,412, filed Feb. 28, 1977, the disclosure of which is hereby incorporated by reference as if set forth at length. The diaphragm can be a gas-tight synthetic material, an ion-exchange membrane or even of limited porosity, so long as diaphragm assembly 24 is not so porous that vacuum generator assembly 26 cannot lower the pressure within the catholyte chamber. Alternatively, an expandable anode assembly could be surrounded by a similar diaphragm (not shown) with vacuum generator assembly 26 attached to a chlorine pipe or a brine inlet.

The cathode assembly 22 is best described with reference to FIGS. 3, 5, 6*a*, 6*b* and 7 and comprises a cathode backplate 52, bus bars 53, a connector bar 54, two planar wire mesh surfaces 56 and 58, channel shaped support ribs 60, 62, 64 and 66, springs 68 and keeper plate 69. Backplate 52 can be cylindrical shaped and serve to close one end of cell body 18, the other end being closed by anode backplate 44 to form an enclosed chamber. Backplate 52 supports external bus bars 53 and internally supports the connector bars 54 which in turn connect wire mesh surfaces 56 and 58 to backplate 52. Wire mesh surface 56 and 58 are spaced slightly from one another to form a substantially planar finger having a slightly open perimeter 70. Wire mesh surfaces 56 and 58 are tack welded or otherwise suitably connected to support ribs 60, 62, 64 and 66 which are biased away from one another by springs 68 which may be of any suitable design and springs 68 are held within a suitable pocket 70 or otherwise connected to ribs 60, 62, 64 and 66. Ribs 60, 62, 64 and 66 may be held from separation by a suitable keeper assembly 69, as seen in FIG. 8.

Keeper assembly 69 comprises rib tops 71, keeper pins 76, keeper plate 72 and nuts 74. Rib tops 71 have surfaces defining keeper pin holes 72 adapted to receive lower ends 78 of keeper pins 76 therein. Keeper plate 72 has a central opening 73 adapted to receive an intermediate portion of the keeper pins therein, so as to allow only limited movement of surfaces 56 and 58 toward or away from each other. Nuts 74 are attached to the top ends of keeper pins 76 to retain the keeper plate 72 around keeper pins 76.

Now the assembly and operation of the preferred embodiment will be described and once again it is pointed out that this is done by way of example and not by way of limitation. The cell 10 is basically assembled in three parts, first the anode assembly 20; second the cathode assembly 22 together with catholyte outlet section 14, caustic outlet 16 and diaphragm assembly 24; and third cell body 18 together with chlorine outlet 12, drain 15 and brine inlet 17. These three parts are then assembled to form the electrolytic cell. A part of this assembly requires that the cathodes be inserted between the anodes. Alternatively the anodes may be inserted between the cathodes. Such insertion involves the movement of at least one of the electrodes past the diaphragm surface, such as shown by arrows 80, 82 and 84 of FIG. 6*a*.

In order to minimize the damage resulting from the movement of the electrodes past the diaphragm, fluid is withdrawn by vacuum generator assembly 26 from the interior of cathode assembly 22 so as to produce a "vacuum", or area of less than ambient pressure, within the cathodic side of cell 10 so as to force diaphragm assembly 24 tightly against the wire mesh surfaces 56 and 58 of cathode assembly 22. A portion of the preferred expandable cathode assembly is shown in FIG. 6*a* in the contracted position which results from the low pressure between mesh surfaces 56 and 58 relative to the ambient pressure existing between anodes in the anodic portion of the cell. This contraction of the wire mesh surface 56 and 58 toward each other is allowed by the support ribs 60, 62, 64 and 66 which are outwardly biased by spring 68 so that when the vacuum generator 26 is disconnected and the pressure on the cathodic side of the cell 10 is allowed to rise to ambient pressure, the wire mesh surfaces 56 and 58 are expanded by the force of springs 68 upon ribs 60, 62, 64 and 66. This expansion continues until either keeper pins 76 reach the outer edges of opening 73 in keeper plate 72 or the wire mesh surfaces 56 and 58 are restrained by diaphragm assembly 24 coming into contact with an adjacent anode. If the latter occurs, the anode to cathode gap is set at the thickness of the walls 55 of the fingers 51 of diaphragm assembly 24, and the springs 68 operate to maintain that gap until such time as keeper pin 76 contact the outer edges of openings 73 after which the width of opening 73 controls the anode to cathode gap. Preferably the keeper plate opening 73 will be sufficiently wide that the pins 76 will only contact the outer edges of opening 73 prior to assembly of cell 10, so that at all times after re-expansion of surfaces 56 and 58 relative to one another, the anode to cathode gap is controlled by springs 68 and is thus held constant at a predetermined distance the thickness of wall 55.

While springs 68 are the preferred expansion means, other expansion means could be used in place thereof. For example, a thermal device could be utilized to expand the wire mesh surfaces 56, 58 in response to heating of the thermal device. The thermal device could be a conventional thermally set material so that once initially expanded the separation of surfaces 56, 58 would be fixed. This would not provide the self-adjustability or reversibility of the springs 68 but would provide a means for allowing a vacuum-contracted cathode assembly during assembly of the cell. Another alternative expansion means would be a swellable material that expands when contacted by water. The swellable material would be used in place of springs 68 and when the cell was assembled would be dry and in contracted form so as to give a contracted cathode assembly and then upon filling of the cell with water or brine, the swellable material would expand to force surfaces 56 and 58 away from one another.

While springs 68 are shown at the top end of ribs 60, 62, 64 and 66, they would be present at least near the bottom of ribs 60, 62, 64 and 66 and could also be used at any number of intermediate positions. Also, ribs 60, 62, 64 and 66 could be integral rather than split if the ribs themselves were the springs or the ribs could serve as springs by outwardly biased resilient contact with each other.

As described above the preferred embodiment has a single diaphragm assembly 24 about the cathode elements 23, the diaphragm assembly being a multiple bag type assembly as shown in FIG. 7. However, an alternative design would be to utilize a diaphragm assembly (not shown) about the anode elements either in addition to or in place of diaphragm assembly 24. In such a modified embodiment, it could be desirable to create a low pressure zone within the anode elements and to construct the anode elements so that they could contract in response to force of a diaphragm assembly against the surface of the anode elements.

The anode to cathode gap could also be predetermined by use of a separator (not shown) placed between the diaphragm fingers 51 and the surface of one or more of the electrodes. Used in conjunction with springs 68, this separator would serve to increase the anode to cathode gap from that gap which would be present were only the diaphragm walls between the electrodes.

While a few modifications have been suggested by way of example and not by way of limitation, other modifications within the scope of this invention will suggest themselves to those of ordinary skill in the art and the invention is intended to cover all such equivalent modifications.

What is claimed is:

1. A method of more effectively assembling a diaphragm electrolytic cell having a foraminous electrode, which comprises the steps of:

a. enclosing said first foraminous electrode with a diaphragm;

b. creating a pressure differential across said diaphragm so as to force said diaphragm against said first electrode;

c. maintaining said pressure differential across said diaphragm while inserting said first electrode between two spaced electrodes; and d. thereafter eliminating said created pressure differential.

2. The method of claim 1, further comprising the step of:

a. contracting said first electrode responsive to said differential pressure force of said diaphragm against said first electrode;

b. maintaining said differential so as to maintain said first electrode contracted until said first electrode is at least partially inserted between said two spaced electrodes to thereby decrease contact between said diaphragm and said two spaced electrodes during said insertion; and c. expanding said first electrode by eliminating said created pressure differential so as to position said first electrode a lesser distance from said two spaced electrodes.

3. The method of claim 2, wherein said electrolytic cell has a gas outlet and said step of creating a pressure differential across said diaphragm further comprises the steps of:

a. connecting a pump to a gas outlet of the electrolytic cell;

b. pumping fluid out of the electrode enclosed by said diaphragm so as to reduce the pressure within a zone defined by said diaphragm to a level below that of the ambient pressure on the exterior of said diaphragm.

4. The method of claim 3, wherein said electrolytic cell has a liquid outlet and said step of creating a pressure differential across said diaphragm further comprises the steps of:

a. connecting a pump to a liquid outlet of the electrolytic cell;

b. pumping fluid out of the electrode enclosed by said diaphragm so as to reduce the pressure within a zone defined by said diaphragm to a level below that of the ambient pressure on the exterior of said diaphragm.

5. The method of claim 3, wherein said electrolytic cell has a liquid outlet and said step of creating a pressure differential across said diaphragm further comprises the step of:

a. plugging one of said liquid and gas outlets to prevent fluid from entering said cell through said plugged outlet.

6. The method of claim 3, wherein said electrolytic cell has a liquid inlet and said step of creating a pressure differential across said diaphragm further comprises the steps of:

a. connecting a pump to a liquid inlet of the electrolytic cell;

b. pumping fluid out of the electrode enclosed by said diaphragm so as to reduce the pressure within a zone defined by said diaphragm to a level below that of the ambient pressure on the exterior of said diaphragm.

7. The method of claim 3, wherein said electrolytic cell has a brine inlet and said step of creating a pressure differential across said diaphragm further comprises the step of:

a. plugging one of said liquid inlet and gas outlet to prevent fluid from entering said cell through said liquid inlet.

8. The method of claim 3, wherein:

a. said first electrode is a cathode; and b. said gas outlet is a hydrogen gas outlet.

9. The method of claim 3, wherein:

a. said first electrode is an anode; and b. said gas outlet is a chlorine gas outlet.

10. The method of claim 2 wherein said lesser distance is equal to the wall thickness of that portion of said diaphragm lying between said first electrode and said two spaced electrodes.

11. The method of claim 2, wherein:

a. said cell has a multiplicity of first foraminous electrodes;

b. said diaphragm is a glovelike structure enclosing each of said first foraminous electrodes, and
c. said steps of contracting, maintaining and expanding said first electrode includes simultaneously contracting, simultaneously maintaining and simultaneously expanding each of said multiplicity of first electrodes.

12. The method of claim 1, wherein said method includes the additional step of attaching said diaphragm to said electrode prior to creation of said pressure differential.

13. The method of claim 1, wherein said diaphragm is attached to a portion of said cell other than said foraminous electrode.

14. The method of claim 1, wherein:
a. said foraminous electrode has a non-foraminous or solid portion, and
b. said diaphragm is attached to said non-foraminous portion.

15. Apparatus for facilitating installation of a first contractible electrode into a cavity of an electrolytic cell during assembly of said cell, comprising:
a. diaphragm means, enclosing said first electrode, for defining a chamber surrounding and including said first electrode and for restricting gas movement across said diaphragm into said defined chamber;
b. vacuum generator means for withdrawing fluid from said defined chamber so as to create and maintain a pressure differential across said diaphragm so as to contract said contractible first electrode and maintain said first electrode contracted during said installation thereof by forcing said diaphragm against said first electrode; and
c. connector means for removably attaching said vacuum generator means to said cell in fluid communication with said defined chamber.

16. The apparatus of claim 15 wherein said apparatus further includes expander means for yieldably opposing said contraction of said first electrode responsive to creation of said pressure differential by said vacuum generator means and for expanding said first electrode in response to the elimination of said created pressure differential.

17. The apparatus of claim 16, further comprising pressure release means, operably attached to said vacuum generator means, for eliminating said pressure differential following insertion of said first electrode between said second and third electrodes.

18. The apparatus of claim 16 wherein said expander means includes a spring.

19. The apparatus of claim 16 wherein said expander means includes a heat responsive expandable material, whereby application of heat to said expander means causes expansion of said first electrode.

20. The apparatus of claim 16 wherein said expander means includes a water responsive expandable material whereby wetting of said expander means causes expansion of said first electrode.

21. The apparatus of claim 15, wherein:
a. said first electrode is an anode;
b. said support means includes a gas outlet and a liquid inlet; and
c. said vacuum generator means is attached to at least one of said gas outlet and said liquid inlet.

22. The apparatus of claim 21, wherein:
a. said vacuum generator means is connected to only one of said liquid inlet means and gas outlet means; and
b. the other of said liquid inlet means and outlet means is plugged.

23. The apparatus of claim 21, wherein:
a. said cell is an electrolytic cell for the production of an alkali metal hydroxide solution and halogen gas from an alkali metal halide solution;
b. said gas outlet is a halogen gas outlet; and
c. said liquid inlet is an alkali metal halide solution inlet.

24. The apparatus of claim 23, wherein:
a. said alkali metal halide solution is a brine solution; and
b. said halogen gas is chlorine gas.

25. The apparatus of claim 15, wherein:
a. said first electrode is a cathode;
b. said cell includes a gas outlet and a liquid outlet; and
c. said vacuum generator means is operably attached to at least one of said gas and liquid outlets.

26. The apparatus of claim 25, wherein:
a. said cell is an electrolytic cell for the production of an alkali metal hydroxide solution and halogen gas from an alkali metal halide solution which produces a by-product gas;
b. said gas outlet is a by-product gas outlet; and
c. said liquid outlet is an alkali metal hydroxide solution outlet.

27. The apparatus of claim 26, wherein:
a. said hydroxide solution is a caustic soda solution;
b. said by-product gas is hydrogen gas; and
c. said alkali metal halide solution is sodium chloride brine.

28. The apparatus of claim 25, wherein:
a. said vacuum generator means is connected to only one of said liquid outlet and gas outlet; and
b. the other of said liquid outlet and said gas outlet is plugged.

29. The apparatus of claim 15, wherein said cavity is the space between a second and third electrode adjacent opposite sides of said first electrode when said first electrode is installed in said cell.

30. The apparatus of claim 29, further comprising installer means for moving said vacuum-contracted first electrode between said second and third electrodes.

31. The apparatus of claim 15 wherein:
a. said cell includes a multiplicity of first foraminous electrodes; and
b. said diaphragm means includes a single multi-fingered glove-like structure, each of said fingers enclosing one of said first electrodes.

32. The apparatus of claim 15, wherein said first electrode is of a polarity opposite that of said second and third electrodes.

33. The apparatus of claim 15, wherein said first electrode comprises a hollow foraminous conductive planar surface.

34. A method of assembling a diaphragm type electrolytic cell having two spaced foraminous electrodes of opposite polarity, which comprises the steps of:
a. enclosing each of said foraminous electrodes with a separate diaphragm;
b. creating a pressure differential across each of said diaphragms so as to force said diaphragms against said foraminous electrodes;
c. maintaining said pressure differential across said diaphragms while interleafing said electrodes; and
d. thereafter eliminating said created pressure differentials.

35. The method of claim 34, further comprising the steps of:

a. contracting said electrodes responsive to said created differential pressure force of said diaphragms against said electrodes;

b. maintaining said created differential pressure so as to maintain said electrodes contracted until said electrodes are at least partially interleaved to thereby decrease contact between said diaphragms during said insertion; and c. expanding said electrodes responsive to elimination of said created pressure differential so as to position said electrodes a lesser distance apart.

36. The method of claim 34, wherein said method includes the additional step of attaching said diaphragm to said electrode prior to creation of said pressure differential.

37. The method of claim 34, wherein said diaphragm is attached to a portion of said cell other than said foraminous electrode.

38. The method of claim 34, wherein:

a. said foraminous electrode has a non-foraminous or solid portion, and b. said diaphragm is attached to said non-foraminous portion.

* * * * *

UNITED STATES PATENT OFFICE

CERTIFICATE OF CORRECTION

Patent No. 4,078,987 Dated March 14, 1978

Inventor(s) Steven J. Specht

Figure 6:
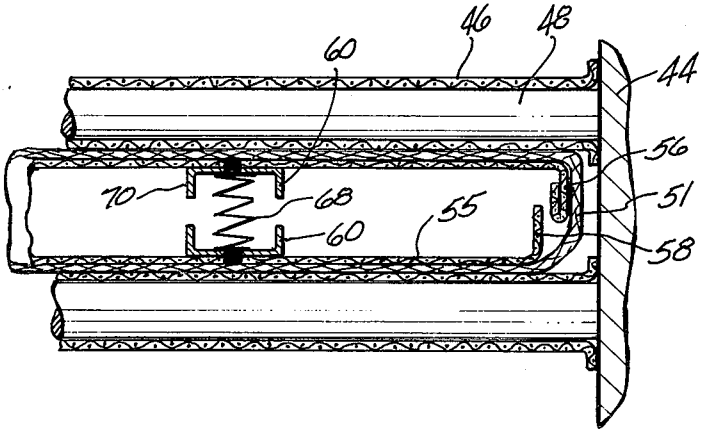

It is certified that error appears in the above-identified patent and that said Letters Patent are hereby corrected as shown below:

FIGURES 6 and 6A in Drawing should be labeled 6b and 6a rather than 6 and 6A, respectively.

Column 2, lines 27-28 and 30-31, delete "taken along lines 6-6 of FIGURE 2" and insert therefor --taken horizontally through the center of the cell of FIGURES 1-4--.

Column 4, lines 2 and 48, reference no. 72 should be added to FIGURE 8 pointing to the keeper plate 72 immediately below nuts 74.

Signed and Sealed this

*Eighth* Day of *August 1978*

[SEAL]

*Attest:*

RUTH C. MASON
*Attesting Officer*

DONALD W. BANNER
*Commissioner of Patents and Trademarks*